United States Patent [19]

Stollenwerk et al.

[11] 4,094,474

[45] June 13, 1978

[54] SLITTING APPARATUS

[75] Inventors: Joseph August Stollenwerk, Oakville; Reinhard Muhs, Orangeville, both of Canada

[73] Assignee: Rotoflex Engraving Limited, Mississauga, Canada

[21] Appl. No.: 773,882

[22] Filed: Mar. 3, 1977

[51] Int. Cl.[2] ..... B65H 35/02; B65H 75/24

[52] U.S. Cl. ..... 242/56.2; 242/72 B; 242/74.1

[58] Field of Search ..... 242/56.2, 56.6, 56.7, 242/67.1 R, 67.3 R, 74, 74.1, 74.2, 72 B, 78.3; 83/854

[56] References Cited

U.S. PATENT DOCUMENTS

| | | | |
|---|---|---|---|
| 2,553,052 | 5/1951 | Kwitck | 242/56.6 X |
| 3,332,636 | 7/1967 | Rockstrom | 242/56.2 |
| 3,536,273 | 10/1970 | Hawkins | 242/56.7 |
| 3,863,857 | 2/1975 | Smith | 242/74.1 |
| 4,004,747 | 1/1977 | Schulze | 242/56.6 |

FOREIGN PATENT DOCUMENTS

| | | | |
|---|---|---|---|
| 222,216 | 8/1968 | Sweden | 242/74.1 |
| 566,335 | 12/1944 | United Kingdom | 242/56.2 |

*Primary Examiner*—Edward J. McCarthy
*Attorney, Agent, or Firm*—Rogers, Bereskin & Parr

[57] ABSTRACT

An apparatus for longitudinally slitting travelling webs of paper and the like is described. The apparatus includes a cutter unit having at least one slitting knife which is adjustable transversely of the path of a web through the apparatus and which can be locked pneumatically in an adjusted position. The apparatus also includes take-up means for winding into rolls, strips of paper and the like formed by slitting the web, and a web clamping assembly disposed in advance of the take-up means. The take-up means includes a mandrel and pneumatic means for clamping the leading portions of strips to be wound onto the mandrel. The clamping assembly is used to assist threading up of the web to the mandrel.

18 Claims, 10 Drawing Figures

SLITTING APPARATUS

This invention relates to apparatus for longitudinally slitting travelling webs of paper and the like to form strips.

An apparatus such as this is used, for example, in the manufacture of labels of the kind which are coated with a pressure sensitive adhesive and have a peel-off backing. Labels of this kind are normally manufactured in the form of a web comprising a backing sheet to which rows of individual labels are applied to the longitudinal direction of the web. These webs are relatively wide and must be reduced to a more manageable form by longitudinal slitting. The resulting strips are formed into rolls each carrying one or more rows of labels.

An object of the present invention is to provide improvements in an apparatus of the kind referred to above.

According to one aspect of the invention, the apparatus includes means for supporting a rolled web to be slit, take-up means for winding into rolls, strips of paper and the like formed by slitting the web, and means for conveying the web in a path which extends from the support means to the take-up means. The slits are formed by a cutter unit disposed adjacent the path of the web. The cutter unit has at least one cutter head including a knife for forming a slit in the web, and means supporting the cutter head for adjustment in a direction transversely of the path of the web to vary the position of the slit formed by the knife in use. The cutter head support means include an elongate member disposed parallel to the direction of adjustment of the cutter head and a locking element which extends longitudinally of the member over the range of adjustment of the head. The elongate member includes a slot receiving the locking element and has an internal cavity communicating with the slot. The locking element is movable in the slot between a locking position in which it engages and prevents movement of the cutter head laterally of the web, and a release position permitting adjustment of the cutter head. An inflatable member is disposed in the cavity in the elongate member and is arranged, when inflated, to move the locking element to its locking position. Means are provided for selectively delivering a fluid pressure medium to the inflatable member to inflate the same and thereby lock the cutter head in an adjusted position.

According to another aspect of the invention, the apparatus includes means for supporting a rolled web of paper to be slit, take-up means for winding into rolls strips of paper and the like formed by slitting the web, and means for conveying the web in a path which extends from the support means to the take-up means. A cutter unit is disposed adjacent the path of the web and includes at least one cutter head having a knife for forming a slit in the web. A web clamping assembly is disposed in advance of the take-up means and downstream of the cutter unit for assisting threading up of the web to the take-up means. The clamping assembly includes a pair of clamping elements extending transversely of and disposed on respectively opposite sides of the web. Means are provided for effecting relative movement of the clamping elements towards and away from one another to respectively clamp and release a web in use and means are also provided for moving the clamping elements between a retracted position remote from the take-up means for clamping of a web, and an advance position adjacent the take-up means in which the web is released for threading to the take-up means.

According to a further aspect of the invention, the apparatus includes means for supporting a rolled web to be slit, take-up means for winding into rolls strips of paper and the like formed by slitting the web, means for guiding the web in a path which extends from the support means to the take-up means, and a cutter unit disposed adjacent the path of the web and including at least one cutter head having a knife for forming a slit in the web. The take-up means include a mandrel which extends about an axis disposed transversely of the path of the web and which is rotatable about the axis to wind the strips onto the mandrel, the mandrel having a longitudinally extending slot for receiving the leading end portions of strips to be wound onto the mandrel, and an internal cavity communicating with the slot. An inflatable member is disposed in the cavity in the mandrel and is arranged, when inflated, to trap against a wall of the cavity, the leading end portions of strips inserted through the slot. Means are provided for selectively delivering a fluid pressure medium to the inflatable member. According to still further aspects of the invention, there is provided a cutter unit for forming slits in travelling webs; a web clamping assembly; and a take-up assembly.

In order that the invention may be more clearly understood, reference will now be made to the accompanying drawings which illustrate a preferred embodiment of the invention by way of example, and in which:

FIG. 4 is a transverse sectional view on line IV—IV of FIG. 2;

Figure 1:
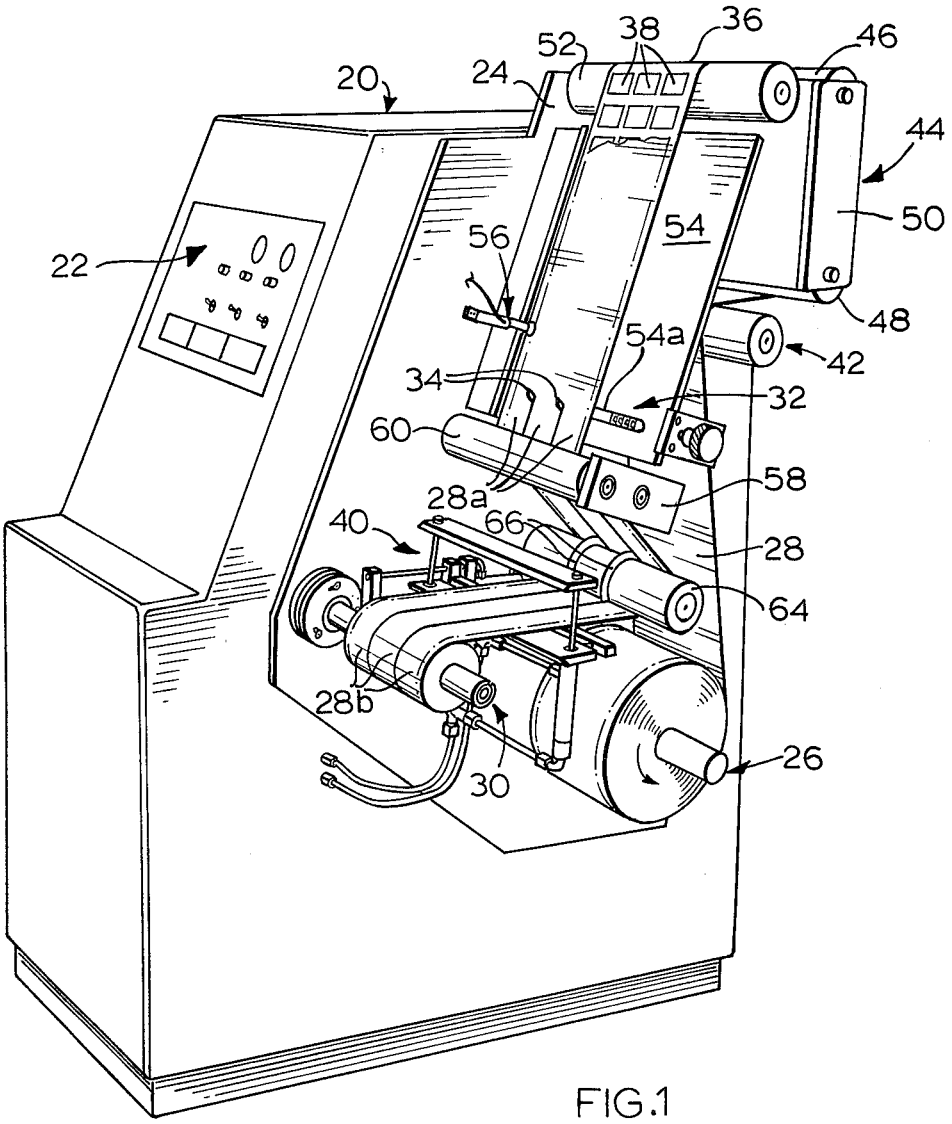
FIG. 1 is a perspective view of an apparatus according to the invention.

Referring first to FIG. 1, the apparatus includes a cabinet generally indicated at 20 which is designed to be self-standing on a floor surface. A control panel 22 is provided at the front of the cabinet and includes various gauges and other indicating devices, control buttons and the like. The control panel is positioned so as to be conveniently accessible to an operative standing in front of the cabinet 20. The control circuitry of the apparatus forms no part of the present invention and will not therefore be described in detail.

At one side of the cabinet 20 is a panel 24 which carries the principal mechanical components of the apparatus. These include a support mandrel 26 for a rolled web 28 to be slit longitudinally, and a take-up mandrel 30 onto which is wound strips formed by longitudinally slitting the web. Mandrel 30 is driven in the direction of the arrow in FIG. 1, while mandrel 26 is allowed to rotate under the control of an air brake (not shown) by which the tension in the web can be controlled. The web is slit by means of a cutter unit 32, which is shown in detail in FIG. 2, and part of which can be seen in FIG. 1. In this embodiment, the cutter unit 32 includes two knives 34 which form corresponding slits in the web and by which the web is divided into three strips 28*a*. These strips are wound onto the mandrel 30 and form three corresponding rolls 28*b*. In the particular embodiment illustrated, web 28 comprises a backing sheet 36 carrying three longitudinally extending rows of individual labels 38 having pressure sensitive coatings on their rear surfaces. The cutters 34 are arranged to form slits between the rows of labels so that each of the resulting rolls 28*b* on mandrel 30 carries one longitudinally extending roll of labels. It is, however, to be understood that this embodiment is referred to by way of illustration only and that the number of knives in the cutter unit and their positions will in practice be varied according to the particular web to be processed.

A web clamping assembly generally denoted 40 is disposed in advance of the take-up mandrel 30 downstream of the cutter unit 32. Assembly 40 is used to assist threading up of the web to the take-up mandrel 30 primarily when the web is to be severed to permit removal of the rolls of strips 28*b* on mandrel 30. The construction and operation of this assembly will be more specifically described later with reference to FIGS. 7 to 10.

In passing from support mandrel 26 to take-up mandrel 30, the web follows a path determined by a number of guide rollers which can be seen in FIG. 1 and which rotate about parallel axes. Thus, the web travels upwardly from mandrel 26 and around a first roller 42 disposed in an overhead position adjacent the rear of cabinet 20. The web then travels substantially horizontally to a guiding unit 44 which includes top and bottom rollers 46 and 48 mounted to rotate between parallel side panels, one of which is visible at 50. After leaving roller 46, the web then travels forwardly to a further guide roller 52 and then downwardly over a flat inclined plate 54. Plate 54 is formed with an opening 54*a* adjacent its lower end through which the knives 34 of the cutter unit protrude.

Immediately upstream in the direction of web travel from the knives 34 is a photoelectric counter head 56 which counts the number of labels on the web. The counter head is connected to circuitry inside the cabinet 20 which can be pre-set from control panel 22 to arrest the web travel when a predetermined number of labels have been counted. However, since the counting arrangement forms no part of the present invention, it will not be described in detail.

Downstream of the knives 34 of the cutter unit adjacent the lower end of the inclined plate 54 are a further pair of guide rollers which extend between the panel 24 and a bracket 58 spaced outwardly of the panel, and one of which is visible at 60. These two rollers together define a nip through which the web passes. On leaving the nip between these rollers, the web then travels rearwardly to a further roller 64 onto which a pair of rings 66 are loosely fitted. These rings fit into the slits formed in the web by the knives 34 of the cutter unit and ensure that the individual strips defined by the slits are fully separate from one another. From roller 64, the web then travels forwardly along a generally horizontal path to mandrel 30.

Figure 2:
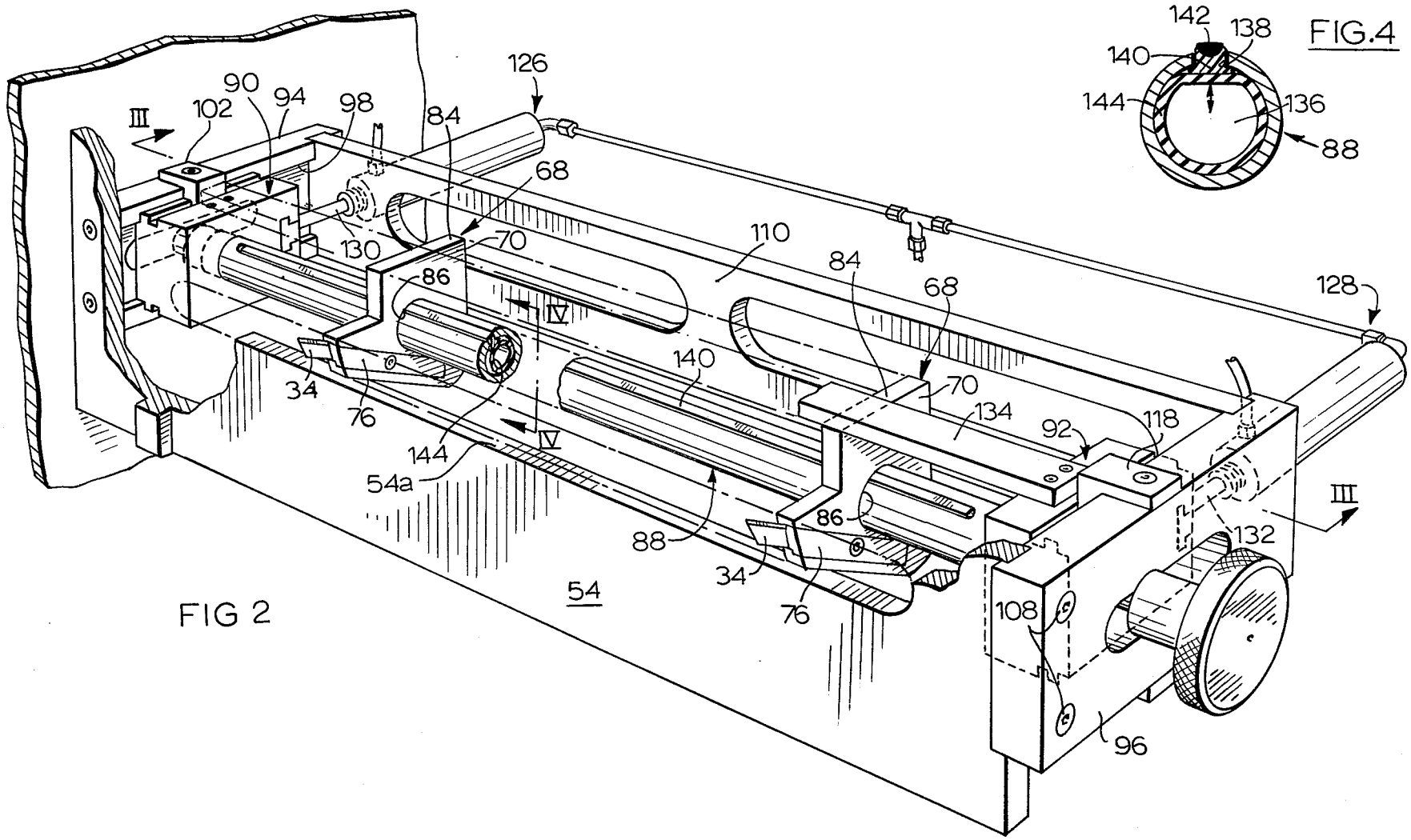
FIG. 2 is a perspective view, partly broken away, of the cutter unit of the apparatus of FIG. 1.
Figure 6:
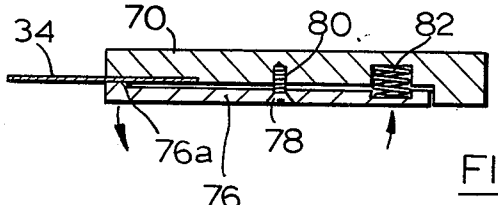
FIG. 6 is a vertical sectional view on line VI—VI of FIG. 5.
Figure 5:
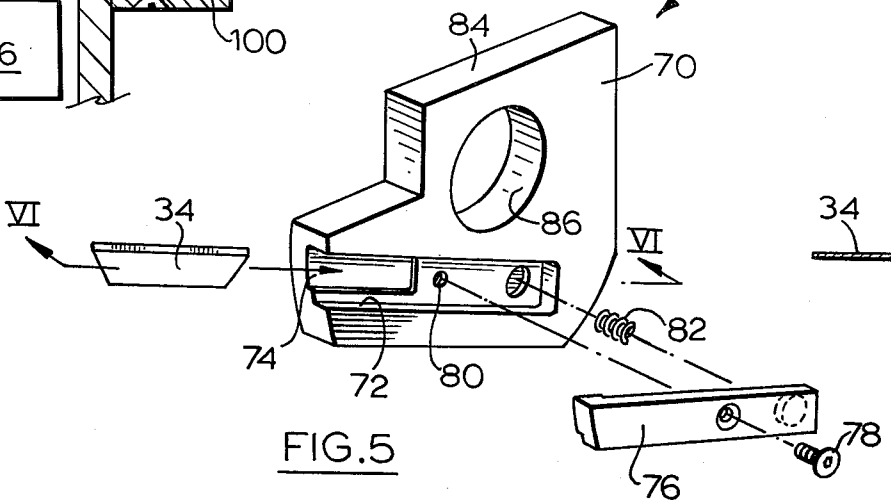
FIG. 5 is an exploded perspective view of one of the cutter heads of the cutter unit.

Reference will now be made to FIG. 2 of the drawings which shows the cutter unit 32 of the apparatus in detail. Unit 32 is mounted on the panel 24 at the side of the cabinet of the apparatus and part of the panel is shown in that view. The lower end portion of the inclined plate 54 is also visible as is the opening 56 through which the slitting knives 34 project. Each knife is in the form of a replaceable blade and forms part of a cutter head 68. Referring briefly to FIGS. 5 and 6, each cutter head also includes a blade mounting plate 70 formed with a slot 72. Slot 72 has a bottom surface which is recessed at 74 to receive the blade 34. A clamping element 76 fits into slot 72 when the cutter head is assembled to clamp the blade against the blade mounting plate 70. As can be seen from FIG. 6, element 76 has a protruding portion 76*a* at one end which actually engages the blade 34. Element 76 is held in place by a single screw 78 disposed approximately at the centre of the length of the element and received in a screw threaded opening 80 in plate 70. A compression spring 82 is arranged between the end of element 76 remote from the protruding portion 76*a* and the plate 70 and is received in corresponding recesses in these two components. Screw 78 is set relatively loosely so that the clamping element 76 adopts generally the position shown in FIG. 6 in which the blade is held in place due to the pivotting effect of spring 82 on element 76 which causes the protruding portion 76*a* of the element to be held against the blade 34. This allows the blade to be released by deflecting the outer end of element 76 outwardly as indicated by the arrow in FIG. 6 so that the inner end of the element tends to compress spring 82. Blade 34 can then be slipped out and replaced by a fresh blade.

The blade mounting plate 70 of the cutter head has a flat upper edge 84 and is formed with a circular opening 86 as can most clearly be seen in FIG. 5. Referring back to FIG. 2, the cutter units are supported for adjustment in a direction transversely of the path of the web to vary the positions of the slits formed by the knives 34. Thus, the cutter heads are mounted on an elongate member 88 of cylindrical form disposed transversely of the path of the web. Member 88 passes through the circular openings in the mounting plates 70 of the cutter heads so that the cutter heads are slidable with respect to the member in the axial direction thereof.

Figure 3:
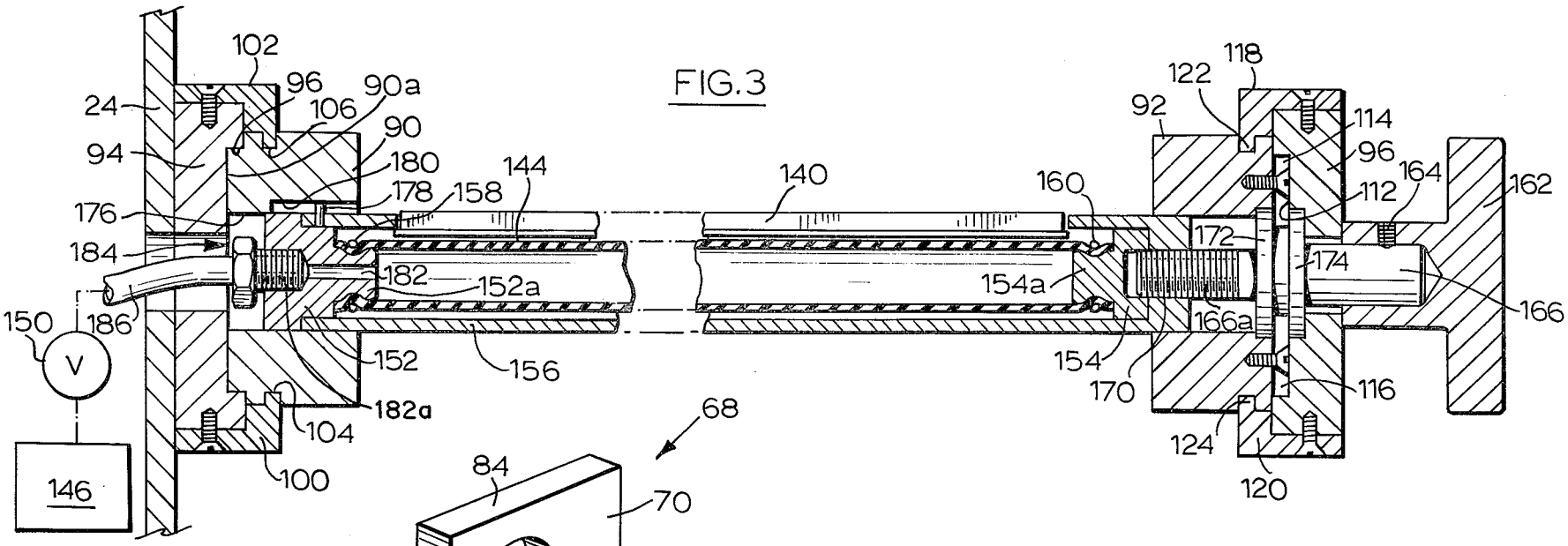
FIG. 3 is a vertical sectional view on line III—III of FIG. 2.

At its ends, member 88 is received in respective slide blocks 90 and 92 (see also FIG. 3). Each of these blocks is slidably coupled to an end plate 94, 96 respectively of the cutter unit. The inner end plate 94 is bolted to the panel 24 at the side of the casing of the apparatus and is shaped to define an inwardly directed slideway 98 which extends in a direction generally normal to the plane containing the incline plate 54 referred to above and which receives a complementarily shaped portion 90*a* of slide block 90. Accordingly, the block is slidable towards and away from plate 54. Angled keep plates 100 and 102 are bolted to the end plate 94 and engage in respective grooves 104 and 106 in the slide blocks to maintain the blocks in contact with end plate 94.

The other end plate 96 of the cutter unit is coupled at one end by bolts 108 to the plate 54 through which the cutter blades 34 project, and at its other end to a plate 110 which extends between the two end plates 94 and 96. Slide block 92 is slidable with respect to end plate 96 in a direction parallel to slide block 90. End plate 96 is formed with an internal slideway 112 and plates 114 and 116 bolted to block 92 are disposed in contact with opposite sides of the slideway. These separate plates contrast with the integral slide formation of slide block 190 since they are required to perform an additional function (to be described). Angled keep plates 118 and 120 are bolted to end plate 96 and engage in complementary grooves 122 and 124 respectively in slide block 92 to retain the slide block in contact with the end plate.

It will be appreciated from the foregoing that the two slide blocks 90 and 92 are movable towards and away from the plate 54 through which the slitting knives 34 project. Since the cutter heads 68 are coupled to the slide blocks by way of member 88, such movement of the slide blocks will adjust the positions of the cutter heads with respect to plate 54. Movement of the slide blocks is effected by a pair of pneumatic cylinder and ram devices 126, 128 coupled one to each of the slide blocks. Thus, it will be seen from FIG. 2 that each of these devices projects outwardly from the plate 110 of the cutter unit with its axis parallel to the direction of movement of the associated slide block. The rams 130 and 132 respectively of the devices pass through plate 110 and are coupled to the associated slide blocks. The two devices are piped together and are coupled to a source of air pressure (not shown) inside the cabinet of the apparatus so as to operate simultaneously. When the rams of the two devices are extended as shown in FIG. 2, the cutter heads adopt forward positions in which the blades 34 project through the slot in plate 54 in operative cutting positions. When the rams are retracted, the blades retract below plate 54 into inoperative positions. Operation of the cylinder and ram devices is controlled by conventional pneumatic circuitry from the control panel 22 of the apparatus. Fine adjustment of the operative (and inoperative) positions of the knives is possible by adjusting the stroke of the cylinder and ram devices.

As indicated previously, the positions of the knives 34 of the cutter unit can be adjusted transversely of the path of the web by sliding the cutter head 68 along member 88. The angular orientation of the cutter heads about member 88 is maintained by a bar 134 (FIG. 2) which extends between the two slide blocks 90, 92 of the cutter unit and against which the flat top edges 84 of the cutter heads slide. For convenience of illustration, part of bar 134 has been indicated in ghost outline only in FIG. 2.

As can best be seen in FIG. 4, member 88 is of hollow cylindrical form and defines an internal cavity 136. An axial slot 138 is formed in the wall of member 88 and communicates with the cavity. An elongate locking element 140 is disposed in slot 138 and the locking element and slot extend along member 88 over the range of adjustment of the cutter heads 68. A rubber rib 142 is secured by adhesive in a generally complementary groove in element 140 and an inflatable sleeve 144 is disposed in the cavity in member 88 in contact with the locking element 140. The sleeve is substantially self-supporting so as to maintain the locking element in slot 138 and can be inflated to move the element to a locking position in which its rib 142 projects above the external surface of member 88 as shown in FIG. 4. Referring back to FIG. 2, the effect of this is to apply the rib against the inner surfaces of the openings 86 in the blade mounting plate 70 of the cutter head 68 so as to prevent movement of the cutter head along member 88.

Inflation of member 144 is effected by connecting the member to a source of compressed air indicated diagrammatically at 146 in FIG. 3. As indicated previously, the apparatus includes a conventional pneumatic circuit (not shown in the drawings) which powers the various air operated components of the apparatus. The compressed air source 146 forms part of this circuit and represents a conventional electric motor driven air pump. Delivery of air to the inflatable member 144 is controlled by a conventional pneumatic valve 150 which is push button operated from the control panel 22 of the apparatus. Accordingly, when the valve is open air pressure is delivered to the interior of member 144 as will be described, inflating the member and locking the cutter head 68 in position. When the apparatus is in operation, member 144 will be inflated in this way. To adjust the cutter head, the web will be arrested and valve 150 closed, allowing member 144 to deflate. Locking element 140 can then move inwardly of member 88, thereby releasing the cutter unit for adjustment along member 88.

FIG. 3 shows the elongate member 88 in section. It will be seen that the member includes two end plugs 152 and 154 which fit into respectively opposite ends of a circular section tube 156. Tube 156 is formed with the said slot 138 which receives the locking element 140. The inflatable member 144 is also visible in section in FIG. 3. Member 144 is in the form of a rubber sleeve fitted at its ends over inwardly directed cylindrical protrusions **152*a* and 154*a* on the respective end plugs 152 and 154. External rings 158 and 160 hold the end portions of the inflatable member 144 on the protrusions 152*a* and 154*a***.

The elongate member 88 is movable axially so that the cutter heads 68 can be adjusted together once the spacing therebetween has been set. For convenience of illustration, the cutter heads themselves are not shown in FIG. 3. Axial movement of member 88 is effected by a handwheel 162 (see particularly FIG. 3) which is held by a grub screw 164 on one end portion of a shaft 166. Shaft 166 extends through an elongate slot 168 in the outer end plate 96 of the cutter unit and has a screw threaded inner end portion **166*a* which is received in a complementarily internally screw threaded opening 170 in the end plug 154 of member 88. Shaft 166 is formed generally at its centre with two parallel flanges 172 and 174 which are spaced from one another to a slight extent and between which are received the plates 114 and 116 described above which are screwed to the outer face of the slide block 92 of the cutter unit. It will be appreciated that, by turning handwheel 162, the elongate member 88 will bee displaced axially by way of the screw threaded coupling between the inner end portion of shaft 166 and the end plug 154 of member 88. Axial movement of shaft 166 is prevented by the two flanges 172 and 174 in co-operation with the end plates 114 and 116. The end plug 152 at the opposite end of member 88 is axially slidable in a plain opening 176 in the slide block 90. A pin 178 projects outwardly from member 88 inside opening 176 and slides in an axial slot 180 formed in the wall of opening 176**.

The end plug 152 of member 88 is formed with an axial opening 182 which has a screw threaded and enlarged outer end portion **182*a* into which a pneumatic pipe union 184 is screwed. Union 184 couples a flexible air hose 186 to member 88** and is itself coupled to the pneumatic system of the apparatus.

Reference will now be made to FIGS. 7 to 10 in describing the web clamping assembly 40 of the apparatus and the take-up mandrel 130. Before describing those views in detail, however, it may be convenient to describe the purpose of the web clamping assembly.

Referring back to FIG. 1, web clamping assembly 40 is used to assist threading up of the web to the take-up mandrel 30 after the web has been severed to remove the rolls 28*b* from mandrel 30. Thus, it will be appreciated that, if the web if severed transversely immediately in advance of mandrel 30, the severed ends of the strips 28*a* upstream of the cut must be accurately rethreaded to mandrel 30 in order to ensure that the strips wind smoothly onto the mandrel when the apparatus is restarted. In the absence of the web clamping assembly 40, this rethreading operation is awkward and time consuming.

Figure 7:
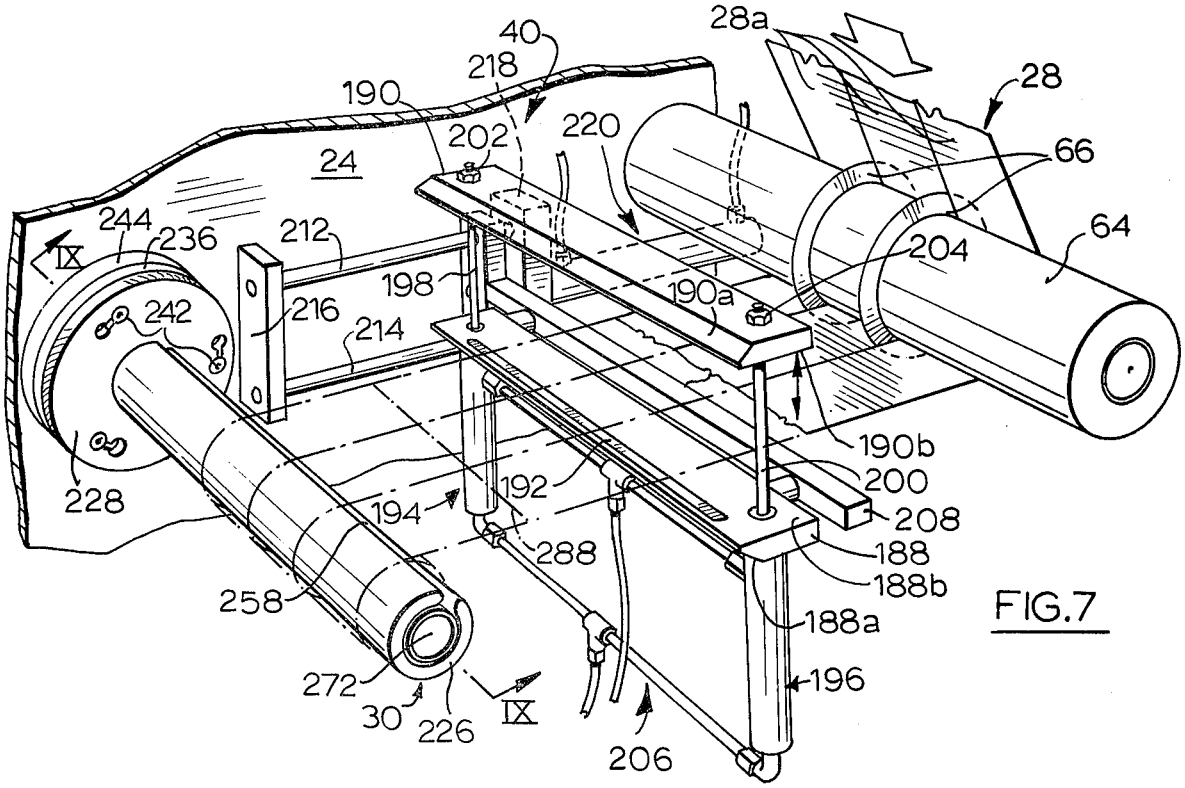
FIG. 7 is a perspective view of the web clamping assembly of the apparatus of FIG. 1, prior to clamping the web.
Figure 8:
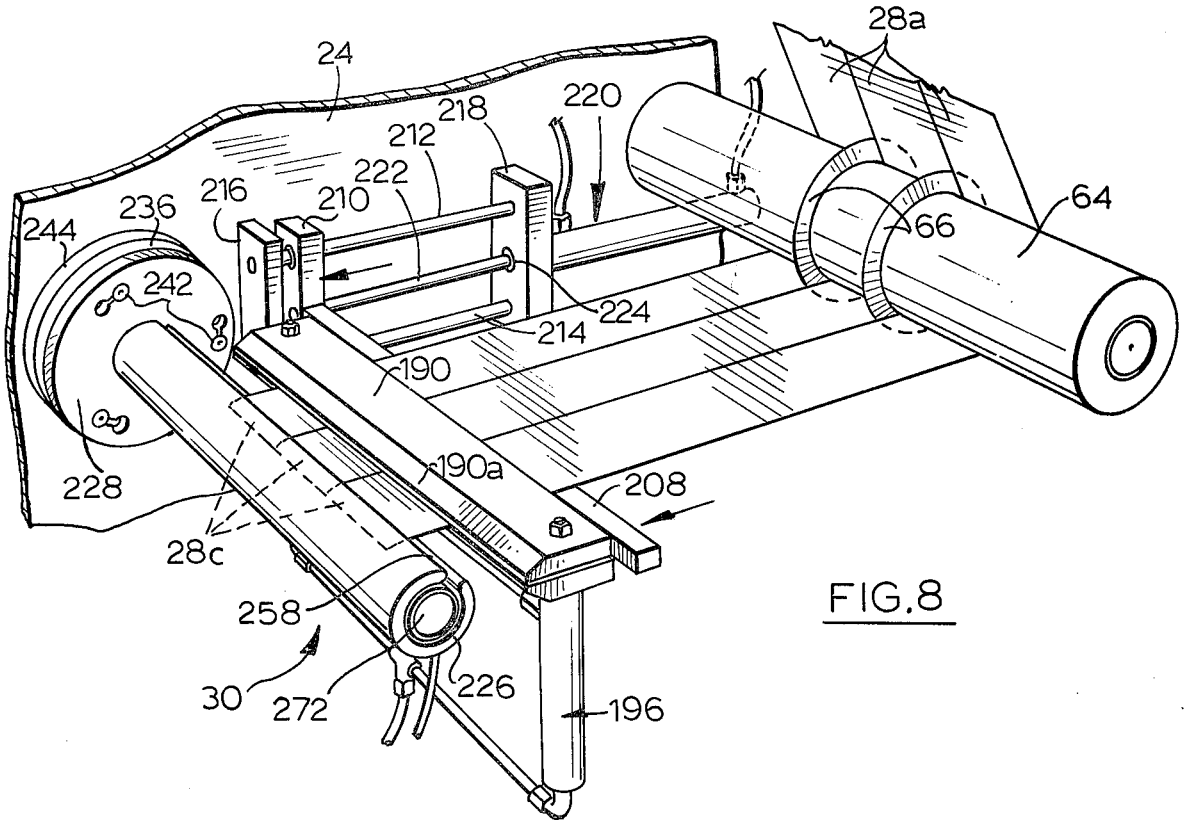
FIG. 8 is a view similar to FIG. 7 showing the clamping assembly in engagement with the web and the web threaded into the take-up means of the apparatus.

Referring now to FIGS. 7 and 8, the web clamping assembly 40 includes a pair of clamping elements 188 and 190 which extend transversely of and are disposed on respectively opposite sides of the web 28. The clamping elements are in the form of rectangular section flat metal bars chamferred at 188*a* and 190*a* to define generally triangular section leading edges. The elements have flat web engaging surfaces 188*b* and 190*b* respectively positioned for contact with respectively opposite sides of the web. Rubber gripper strips are provided on the surfaces 188*b* and 190*b* adjacent the leading edges of the respective elements. The gripper strip for element 188 is indicated at 192 in FIG. 7.

The lower web clamping element 188 is disposed in a fixed position immediately below the path of the web so that the web runs over the flat upper surface 188*b* of the element. The other element is movable towards and away from element 188 to respectively clamp and release a web in use. Movement of element 190 is effected by a pair of pneumatic cylinder and ram devices 194 and 196 which are mounted in parallel vertical positions below the lower clamping element 188. Thus, the cylinders of the respective devices 194 and 196 are mounted on the lower surface of element 88 adjacent respectively opposite ends of the element. The rams 198 and 200 of these devices project through openings in element 188 and through aligned openings in the upper clamping element 190. The outer end portions of the rams are screw threaded and fitted with nuts respectively above and below element 190 to attach the element to the rams. The upper nuts are visible at 202 and 204 in FIGS. 7 and 8. The cylinder and ram devices 194 and 196 are coupled together by pneumatic piping indicated at 206 and connected in the pneumatic system of the apparatus so that the two devices operate simultaneously.

The lower clamping element 188 is attached to a support bar which projects generally horizontally from the casing of the apparatus. At its inner end bar 208 is attached to an upright member 210 (best seen in FIG. 8) which in effect forms a cross head slidably mounted on parallel bars 212 and 214 disposed in generally horizontal positions and extending in the direction of web travel. These bars are carried by end plates 216 and 218 attached to the panel 24 of the side of the casing of the apparatus (see FIG. 1). It will be appreciated that movement of the cross head 210 along the bars 212 and 214 will cause corresponding movement of the clamping elements 188 and 190. Thus, the elements are movable between a retracted position in which they are shown in FIG. 7, remote from the take-up mandrel 30, and an advanced position adjacent the mandrel in which they are shown in FIG. 8. Movement of the clamping elements between these positions is effected by a further pneumatic cylinder and ram device 220 which is mounted in a horizontal position on the end plate 219 with its axis parallel to the rods 212 and 214. Thus, the cylinder of device 220 is attached to plate 218, while the ram 222 projects through an opening 224 in plate 218 and is attached at its outer end to the cross head 210. Here again, the cylinder and ram device 220 is coupled in the pneumatic circuit of the machine.

Figure 9:
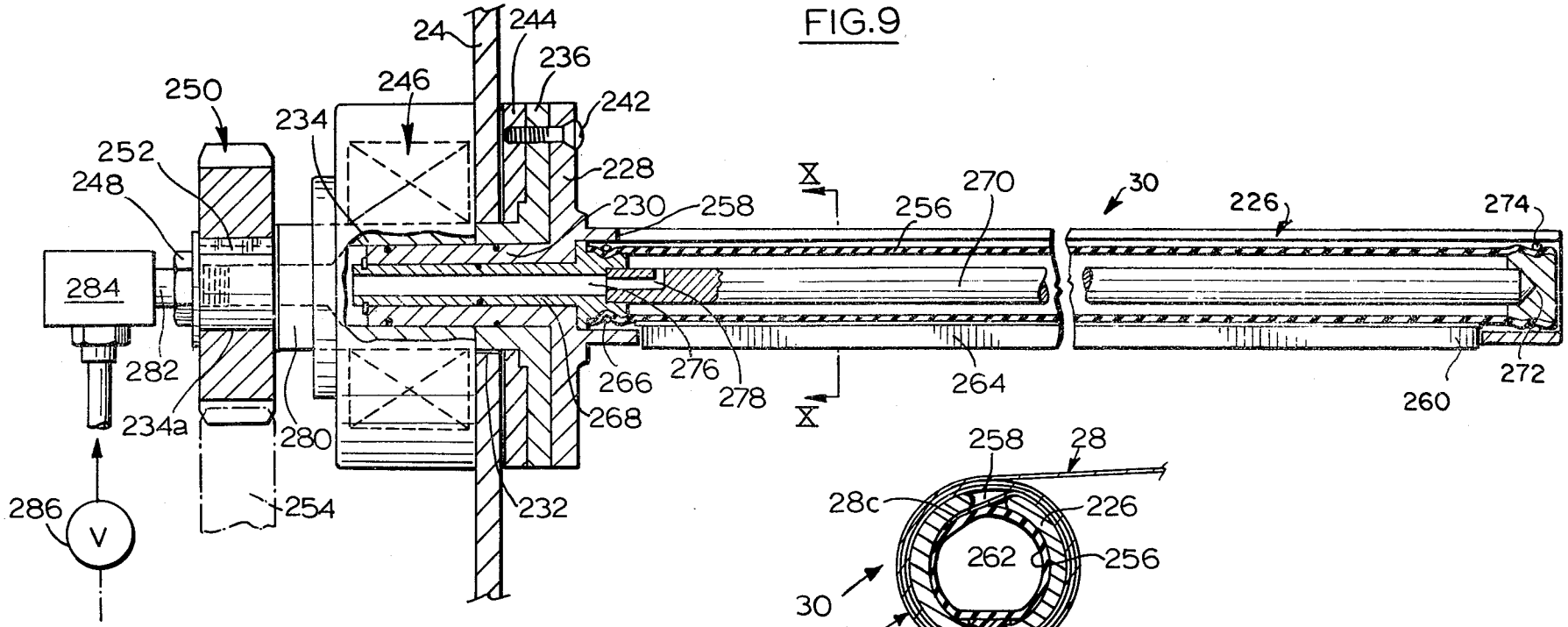
FIG. 9 is a vertical sectional view on line IX—IX of FIG. 7.
Figure 10:
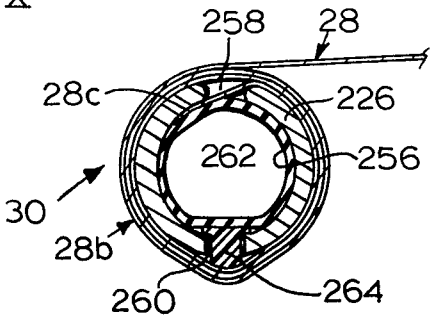
FIG. 10 is a transverse sectional view on line X—X of FIG. 9.

FIGS. 9 and 10 show the take-up mandrel and associated support and drive structure in detail. Part of the panel 24 at the side of the casing of the apparatus is visible in FIG. 9. Mandrel 30 projects outwardly from panel 24 to the right in FIG. 9 while the structure shown to the left of panel 24 is inside the casing. Mandrel 30 includes an outer, hollow cylindrical member 226 having a circular flange 228 at its inner end. A hollow cylindrical extension 230 of member 226 projects outwardly from the opposite side of flange 228 and extends through an opening 232 in casing panel 24. Extension 230 is slidably received in an outer sleeve 234 which also extends through the opening 232 in panel 24 externally of extension 230. At its outer end, sleeve 234 has an integral circular flange 236 disposed at the inner side of flange 228. The two flanges 236 and 228 are formed with aligned holes to receive three clamping screws 242 (only one of which is visible in FIG. 9) for removably securing the mandrel to the flange 236 by way of its flange 228. A separate clamping ring 244 is provided at the inner side of flange 236 and is formed with screw threaded holes to receive the screws 242. The holes through which the screws pass in the outer flange 228 are key hole shaped as can be seen in FIGS. 7 and 8 so that the mandrel can readily be removed by loosening the screws and turning the flange 238 to bring the wide ends of the key hole shaped openings into register with the screw heads, allowing the mandrel to be withdrawn in the axial direction of member 226. This facility allows ready replacement of the mandrel with a mandrel of a different size and/or type if required by the operation to be performed using the apparatus.

Inside the casing of the apparatus, sleeve 234 is received in a bearing 246 attached to the inner side of panel 24, which allows the sleeve and hence the mandrel to rotate. Sleeve 234 projects outwardly of the bearing housing 246 and has a reduced outer end portion 234a which is externally screw threaded and fitted with a nut 248. A gear wheel 250 is mounted on the reduced portion 234a of sleeve 234 and is coupled to the sleeve by a key 252. Sleeve 234 and hence the mandrel 30 are driven in rotation by a further gear indicated in chain line at 254 arranged in mesh with gear 250 and driven from an air motor forming part of the pneumatic circuit of the apparatus.

Mandrel 30 includes a pneumatic arrangement for retaining the end of the web or web strips to be wound onto the mandrel and for facilitating removal of rolls of strips from the mandrel. Thus, as can be seen from FIG. 10, the cylindrical member 226 of the mandrel defines an internal cavity which receives an inflatable member 256, and two diametrically opposed slots 258 and 260 which extend longitudinally of the mandrel. Slot 258 extends over substantially the whole of the length of member 226 and opens into its outer end. The slot is defined by rounded opposed edges 262 (FIG. 10) and is intended to receive the leading end portion of a web or web strip to be coupled to the mandrel. In FIG. 10, the leading end portion of one of these strips is indicated at 28c and is shown inserted through slot 258 and engaged between the inner surface of the cylindrical member 226 and the inflatable member 256. By inflating member 256, portion 28c of the strip is gripped inside the mandrel.

The other slot 260 in the cylindrical member 226 receives an elongate element 264 similar to the locking element 140 shown in FIG. 4. This element bears against the inflatable member 256 and can be projected above the external surface of cylindrical member 226 by inflating element 256. This has the effect of temporarily enlarging to a slight extent the circumferential dimension of the mandrel so that the strips wound onto the mandrel are held clear of the member in the vicinity of element 264. When the rollers are to be removed from the mandrel, the member 256 is deflated, allowing element 264 to move inwardly and thereby reducing the effective circumferential dimension of mandrel 226 so that the rolls can be readily slid off the mandrel.

Referring to FIG. 9, the inflatable member 256 is in the form of a rubber sleeve disposed co-axially with the cylindrical member 226. At its inner end sleeve 256 is secured by an external ring clip 266 to an enlarged end portion of tubular member 268 disposed inside the extension 230 of cylindrical member 226. A rod 270 extends outwardly from member 268 co-axially with cylindrical member 226 and carries a short cylindrical element 272 at its outer end to which the outer end of the rubber sleeve 256 is secured by a clip 274. Member 268 defines an internal air passageway 276 which communicates with the interior of the inflatable rubber sleeve 256 by way of a passageway 278 in rod 270. The outer sleeve 234 of the mandrel support also defines an air passageway 280 which communicates with passageway 276 and with an air coupling 282 which receives air from the pneumatic circuit of the machine through a rotary valve 284. An on-off valve 286 operable from the control panel 22 of the apparatus controls the supply of air from the pneumatic circuit to the inflatable member 256 inside the mandrel.

FIGS. 7 and 8 illustrate the threading up of a web to the mandrel 30. In FIG. 7, the web clamping apparatus 40 is shown in a position immediately prior to the performance of a web severing operation. Part of the web is shown in chain dotted outline for clarity of illustration. With the web stationary, the rams of the two cylinder and ram devices 194 and 196 are retracted to lower clamping element 190 and clamp the web between it and the lower clamping element 188. The web is then severed generally along line 288. The air supply valve 286 of the mandrel is now closed, deflating the internal sleeve 256 and allowing element 264 to move inwardly so that the rolls 28a can be removed from the mandrel. Next, the cylinder and ram device 220 is operated to extend its ram and move the two clamping elements 188, 190 from their retracted position of FIG. 7 to the advanced position of FIG. 8 in which the are disposed closely adjacent and parallel to the mandrel 30.

Mandrel 30 is now turned to bring the leading end portions 28c of the web strips into the positions in which they are shown in FIG. 8 between the inner inflatable member 256 and the inner surface of the outer cylindrical member 226 of the mandrel as described in connection with FIG. 10. The mandrel air supply of valve 286 is then opened to inflate the internal member 256 and clamp the strips 28a in the mandrel. Next, the rams of the cylinder and ram devices 194, 196 are extended to lift the upper clamping element and release the web. Finally, the ram of cylinder and ram device 220 is retracted to return the clamping element to the position of FIG. 7. The apparatus is then restarted and slitting of the web continues.

While the primary purpose of the web clamping device is to assist in threading up severed strips of web to the mandrel, it may also be used during initial threading up of the machine. At that time, the cutter heads 68 (FIG. 2) will be retracted and the web will be threaded manually through the apparatus and will not be slit. Accordingly, it may be convenient to manually feed the web into the mandrel rather than using the web clamping device. However, this will depend on the individual preference of the operator of the apparatus.

It should finally be noted that the preceding description relates to a specific embodiment and that many modifications of the invention are possible within the broad scope of the invention. For example, it is to be understood that the cutter unit, web clamping assembly and mandrel need not necessarily be used together but could be incorporated individually into a web slitting apparatus. Also, it is to be noted that while the apparatus has been described as a self-contained machine, the apparatus could form part of a larger machinee, e.g. a printing press.

Referring specifically to the cutter unit shown in FIGS. 2 to 6 of the drawings, it is to be noted that the cutter heads need not necessarily be mounted on the elongate member which incorporates the locking element. For example, separate guiding means could be provided to allow the cutter heads to move transversely of the web and the elongate member (88) could be mounted parallel to the path of movement of the cutter heads with the locking element arranged to bear against the cutter heads to lock them in their adjusted positions. Of course, while reference has been made to two cutter heads, the cutter unit could incorporate only a single head or more than two heads.

Referring to the web clamping assembly of FIGS. 7 and 8, it should be noted that the clamping elements need not necessarily be arranged so that the upper element moves with respect to the lower; it is merely necessary that the elements be movable relative to one another to clamp and release the web.

Finally, while the disclosure refers exclusively to an apparatus having pneumatically operated components, it is to be understood that hydraulic or a combination of hydraulic and pneumatic operation may be employed.

What we claim is:

1. Appartus for longitudinally slitting travelling webs of paper and the like to form strips, the apparatus comprising:

means for supporting a rolled web to be slit;

take-up means for winding into rolls, strips of paper and the like formed by slitting the web;

means for guiding the web in a path which extends from said support means to said take-up means; and, a cutter unit disposed adjacent the path of the web and comprising: at least one cutter head including a knife for forming a slit in the web; and means supporting said cutter head for adjustment in a direction transversely of the path of the web to vary the position of the slit formed by said knife in use; said support means including: an elongate member disposed parallel to the direction of adjustment of the cutter head; a locking element which extends longitudinally of said member over the range of adjustment of said head, the member including a slot receiving said locking element and having an internal cavity communicating with said slot, and the element being movable in the slot between a locking position in which it engages and prevents movement of the cutter head laterally of the web, and a release position permitting adjustment of the cutter head; an inflatable member disposed in said cavity in the elongate member and arranged, when inflated, to move the locking element to its locking position; and means for selectively delivering a fluid pressure medium to said inflatable member to inflate the same and thereby lock the cutter head in an adjusted position.

2. An apparatus as claimed in claim 1, wherein said take-up means includes: a mandrel which extends about an axis disposed transversely of the path of the web and which is rotatable about said axis to wind said strips onto the mandrel, the mandrel including a longitudinally extending slot for receiving the leading end portions of strips to be wound onto the mandrel, and having an internal cavity communicating with said slot; an inflatable member disposed in said cavity in the mandrel and arranged, when inflated, to trap against a wall of said cavity, said leading end portions of strips inserted through said slot; and means for selectively delivering a fluid pressure medium to said inflatable member;

and wherein said apparatus further includes a web clamping assembly disposed in advance of said take-up means and downstream of the cutter unit for assisting threading up of the web to said take-up means, said assembly including:

a pair of clamping elements extending transversely of and disposed on respectively opposite sides of the web;

means supporting the clamping elements for relative movement towards and away from one another to respectively clamp and release a web in use; and for movement together between a retracted position for clamping of a web, and an advanced position adjacent said take-up means for threading up of the web to said take-up means; and, means operable to move the clamping elements in a sequence in which the elements clamp the web at a position spaced from said take-up means, move the web to said advanced position, release the web after threading thereof to said take-up means, and return the clamping elements to said retracted position.

3. An apparatus as claimed in claim 1, wherein said elongate member supports the cutter head for adjustment in said direction transversely of the path of the web, the cutter head defining an opening through which the member extends and the opening having an inner edge against which said locking element acts when the element is moved to its locking position by said inflatable member.

4. An apparatus as claimed in claim 3, wherein said elongate member defines a cylindrical outer surface, and wherein the cutter head includes: a mounting plate formed with said opening, said opening being of circular shape and of a size such that the plate is a close sliding fit on said member; and means replaceably coupling said knife with said plate.

5. An apparatus as claimed in claim 3, wherein said elongate member is movable between a first position in which said knife of the cutter head is disposed in the path of the web for forming a slit therein, and a second position in which the knife is retracted clear of the web path, and wherein said cutter head support means further includes fluid pressure operated means for selectively moving said elongate member between said first and second positions.

6. Appartus for longitudinally slitting travelling webs of paper and the like to form strips, the apparatus comprising:

means for supporting a rolled web of paper to be slit;

take-up means for winding into roll strips of paper and the like formed by slitting the web;

means for guiding the web in a path which extends from said support means to said take-up means;

a cutter unit disposed adjacent the path of the web and including at least one cutter head having a knife for forming a slit in the web; and, a web clamping assembly disposed in advance of said take-up means and downstream of the cutter unit for assisting threading up of the web to said take-up means, said assembly including:

a pair of clamping elements extending transversely of and disposed on respectively opposite sides of the web;

means supporting the clamping elements for relative movement towards and away from one another to respectively clamp and release a web in use; and for movement together between a retracted position for clamping of a web, and an advanced position adjacent said take-up means for threading up of the web to said take-up means; and, means operable to move the clamping elements in a sequence in which the elements clamp the web at a position spaced from said take-up means, move the web to said advanced position, release the web after threading thereof to said take-up means, and return the clamping elements to said retracted position.

7. An apparatus as claimed in claim 6, wherein one of said clamping elements is disposed in a fixed position adjacent the path of the web so that the web runs in contact with said element, and wherein the means operable to move the clamping elements include first and second fluid pressure operated cylinder and ram devices disposed adjacent respectively opposite ends of the fixed clamping element and coupled to said element, said devices extending about parallel axes disposed generally normal to the path of the web, and the rams of said devices being coupled to the movable clamping element and arranged to move said element towards the fixed element and clamp the web when the rams of the devices are simultaneously retrcted, and to move the said element away from the web to release the same when the rams of the devices are simultaneously extended.

8. An apparatus as claimed in claim 7, wherein said means operable to move the clamping elements include a further fluid pressure operated cylinder and ram device extending about a longitudinal axis and disposed with its axis generally parallel to the portion of the web path in advance of said take-up means, and wherein the clamping element support means include a support element coupled to said fixed clamping element and having an inner end disposed laterally of the web, and a cross head coupled to said inner end of the support element, and wherein the ram of said further cylinder and ram device is coupled to said cross head so that the clamping elements can be moved together between said retracted and advanced positions by operating said further cylinder and ram device.

9. Apparatus for longitudinally slitting travelling webs of paper and the like to form strips, the apparatus comprising:

means for supporting a rolled web to be slit;

take-up means for winding into roll strips of paper and the like formed by slitting the web;

means for guiding the web in a path which extends from said support means to said take-up means; and, a cutter unit disposed adjacent the path of the web and including at least one cutter head having a knife for forming a slit in the web;

wherein said take-up means include: a mandrel which extends about an axis disposed transversely of the path of the web and which is rotatable about said axis to wind said strips onto the mandrel, the mandrel including a longitudinally extending slot for receiving the heading end portions of strips to be wound onto the mandrel, and having an internal cavity communicating with said slot; an inflatable member disposed in said cavity in the mandrel and arranged, when inflated, to trap against a wall of said cavity, said leading end portions of strips inserted through said slot; and means for selectively delivering a fluid pressure medium to said inflatable member.

10. An apparatus as claimed in claim 9, wherein said mandrel includes a second longitudinally extending slot communicating with said cavity and spaced from said first mentioned slot; and wherein the take-up means further includes an elongate element which is disposed in said slot and which is movable by said inflatable member to a position in which the element protrudes from the external surface of the mandrel for winding of said strips onto the same.

11. An apparatus as claimed in claim 9, wherein said take-up means includes mandrel support means adapted to normally support said mandrel for rotation about its said axis, and wherein the mandrel and support means are releasably coupled together to allow ready replacement of the mandrel.

12. A cutter unit for forming slits in travelling webs of paper and the like, the unit comprising: at least one cutter unit including a knife for forming a slit in a web of paper and the like; and means adapted to support the cutter head for adjustment in a direction transversely to said web in use to vary the position of the slit to be formed by the knife; said support means including: an elongate member disposed parallel to said direction of adjustment of the cutter head; a locking element which extends longitudinally of the member over the range of adjustment of the head, the member including a slot receiving said locking element and having an internal cavity communicating with said slot, and the element being movable in the slot between a locking position in which it engages and prevents movement of the cutter head laterally of the web, and a release position permitting adjustment of the cutter head; an inflatable member disposed in said cavity in the elongate member and arranged, when inflated, to move the locking element to its locking position; and means for coupling said inflatable member with a source of fluid pressure when the cutter head is in use.

13. An assembly for clamping a web of paper and the like including: a pair of clamping elements adapted to be disposed transversely of and on respectively opposite sides of a web to be clamped;

means supporting the clamping elements for relative movement towards and away from one another to respectively clamp and release a web in use, and for movement together between first and second positions spaced along the web;

means for effecting such relative movement of the clamping elements; and, means for moving the clamping elements between said first and second positions.

14. A take-up assembly for webs of paper and the like, the assembly comprising: a mandrel which extends about a longitudinal axis; means for supporting said mandrel for rotation about said axis to wind a web onto the mandrel; the mandrel including a longitudinally extending slot for receiving the leading end portion of said web, and an internal cavity communicating with said slot and defined by a cylindrical inner surface of said mandrel; an inflatable member disposed in said cavity in the mandrel and arranged, when inflated, to trap said leading end portions of said web against a portion of said cylindrical inner surface of the mandrel; and means for selectively delivering a fluid pressure medium to said inflatable member to inflate the same.

15. Apparatus for longitudinally slitting travelling webs of paper and the like to form strips, the apparatus comprising:

means for supporting a rolled web to be slit;

take-up means for winding into rolls strips of paper and the like formed by slitting the web;

means for guiding the web in a path which extends from said support means to said take-up means; and, a cutter unit disposed adjacent the path of the web and including at least one cutter head having a knife for forming a slit in the web;

wherein said take-up means include: a mandrel which extends about an axis disposed transversely of the path of the web and which is rotatable about said axis to wind said strips onto the mandrel; mandrel support means adapted to normally support said mandrel for rotation about its said axis; and means releasably coupling the mandrel and support means to allow ready replacement of the mandrel; said mandrel support means including a support flange mounted on a fixed part of the apparatus for rotation about said axis of the mandrel in a plane generally normal to said axis; and said mandrel including a corresponding flange coupled to said support flange by said releasable coupling means; and wherein the apparatus further includes drive means coupled to said support flange for rotating the flange and, with it, the mandrel about said axis of the mandrel.

16. An apparatus as claimed in claim 15, wherein said releasable coupling means comprise a plurality of screws extending through keyhole-shaped openings in the mandrel flange and releasably coupled to said support flange, each said opening including a narrow end portion and a wide end portion, and the openings being arranged so that the mandrel flange can be turned relative to the support flange between an operative position in which all of the said screws are disposed in the narrow end portions of the associated openings, and can be tightened onto said mandrel flange to secure the same to said support flange, and a release position in which all of said screws are disposed in said wide end portions of the openings so that the mandrel flange can be removed over the heads of said screws.

17. An apparatus as claimed in claim 15, wherein said mandrel has a longitudinally extending slot for receiving the leading end portions of strips to be wound onto the mandrel, and an internal cavity communicating with said slot; and wherein the take-up means further includes an inflatable member disposed in said cavity in the mandrel and arranged, when inflated, to trap against a wall of said cavity, said leading end portions of strips inserted through said slot; and means for selectively delivering a fluid pressure medium to said inflatable member.

18. In an apparatus in which a web of paper and the like is to be wound from a roll onto take-up means, an assembly for clamping the web comprising:

a pair of clamping elements extending transversely of and disposed on respectively opposite sides of the path of the web adjacent said take-up means;

means supporting the clamping element for relative movement towards and away from one another to respectively clamp and release a web in use, and for movement together between a retracted position and an advanced position adjacent said take-up means for threading up of the web to said take-up means; and, means operable to move the clamping elements in a sequence in which the elements clamp the web at a position spaced from said take-up means, move the web to said advanced position, release the web after threading thereof to said take-up means, and return the clamping elements to said retracted position.

* * * * *